US005332129A

United States Patent [19]

Brattoli et al.

[11] Patent Number: 5,332,129

[45] Date of Patent: Jul. 26, 1994

[54] SOAP DISPENSER ASSEMBLY

[75] Inventors: Michael A. Brattoli; Roy W. Burns, both of Elyria, Ohio

[73] Assignee: Moen Incorporated, Elyria, Ohio

[21] Appl. No.: 76,975

[22] Filed: Jun. 16, 1993

[51] Int. Cl.[5] ..... B67D 5/00

[52] U.S. Cl. ..... 222/321; 222/383; 239/333

[58] Field of Search ..... 222/321, 383, 385, 378; 239/333, 375, 579, 541

[56] References Cited

U.S. PATENT DOCUMENTS

| | | | |
|---|---|---|---|
| 1,937,344 | 11/1933 | Hollingsworth | 222/385 |
| 2,693,899 | 11/1954 | Trout | 222/385 X |
| 2,772,116 | 11/1956 | Dobkin | 222/321 |
| 3,478,935 | 11/1969 | Brooks | 222/321 |
| 3,664,556 | 5/1972 | Perry et al. | 222/385 |
| 4,077,549 | 3/1978 | Beard | 222/321 |
| 4,146,155 | 3/1979 | Kutik et al. | 222/385 X |
| 4,355,962 | 10/1982 | Magers | 222/321 X |
| 4,429,813 | 2/1984 | DeFreitas | 222/385 X |
| 4,561,571 | 12/1985 | Chen | 222/383 X |
| 4,643,338 | 2/1987 | Iizuka | 222/321 |
| 4,826,031 | 5/1989 | Ruscitti | 222/321 X |
| 5,050,782 | 9/1991 | Cheng | 222/321 X |
| 5,110,271 | 5/1992 | Hofmann | 222/321 X |

FOREIGN PATENT DOCUMENTS

| | | | |
|---|---|---|---|
| 8900137 | 1/1989 | World Int. Prop. O. | 222/321 |

*Primary Examiner*—Andres Kashnikow
*Assistant Examiner*—Anthoula Pomreninz
*Attorney, Agent, or Firm*—Dorn, McEachran Jambor & Keating

[57] ABSTRACT

A soap dispenser includes a pump assembly having an outwardly extending reciprocal plunger. A handle assembly is pivotally mounted to the pump assembly and includes an outwardly projecting operating handle. There is a discharge tube in the handle assembly which has an outlet adjacent the end of the handle. A connector is seated on the pump assembly and is attached to the handle assembly. The discharge tube which is attached to the connector, in cooperation with the connector and the pump assembly plunger, provides a soap passage, normally filled with soap, which extends between the pump assembly and the outlet. There is a check valve in the soap passage. Pivotal movement of the handle has the effect of moving the pump assembly plunger in an inward direction resulting in a measured amount of soap being moved through the soap passage and discharged from the outlet.

12 Claims, 2 Drawing Sheets

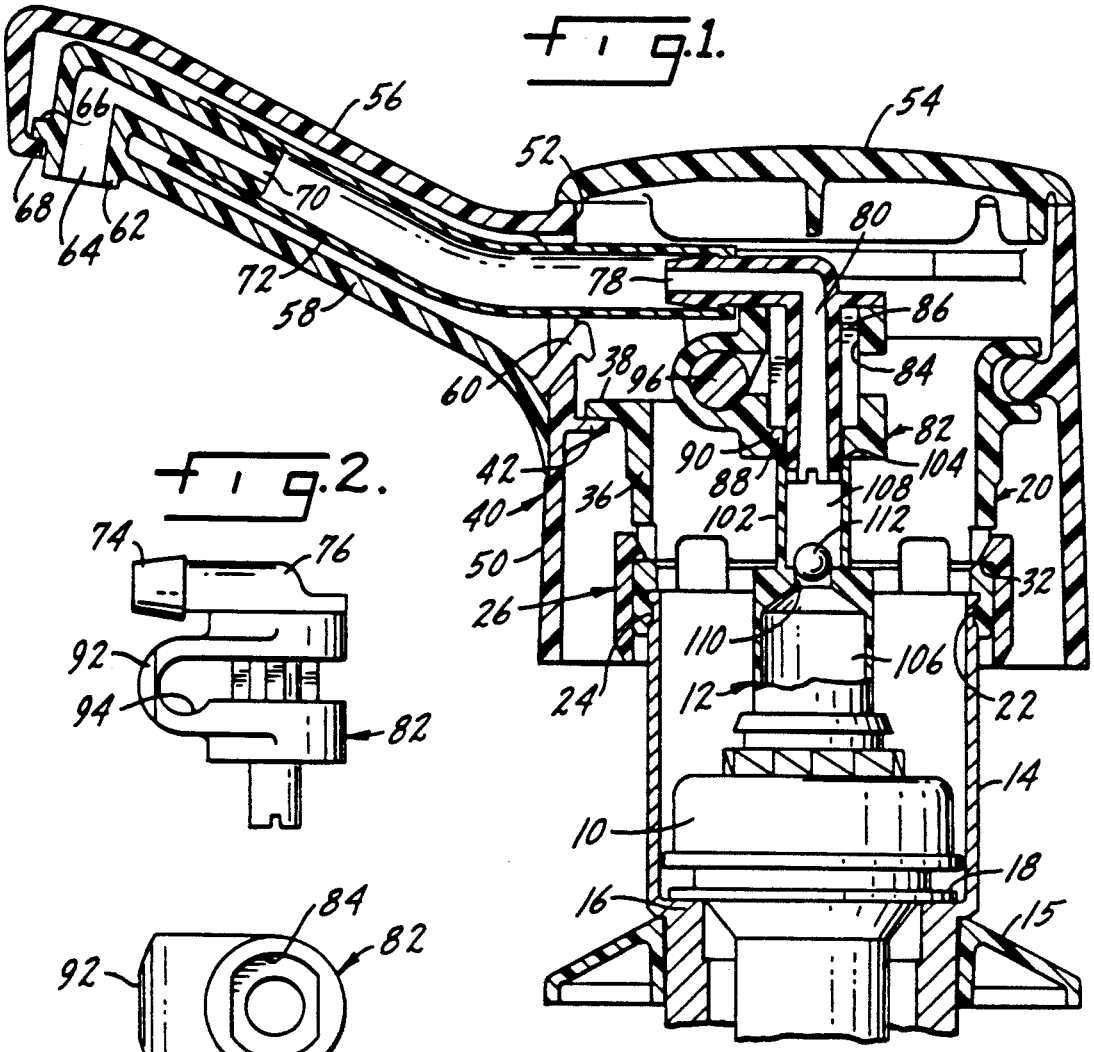
Fig. 1.
Fig. 2.
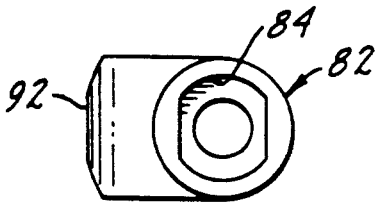
Fig. 3.
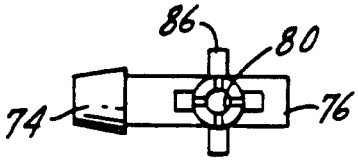
Fig. 4.
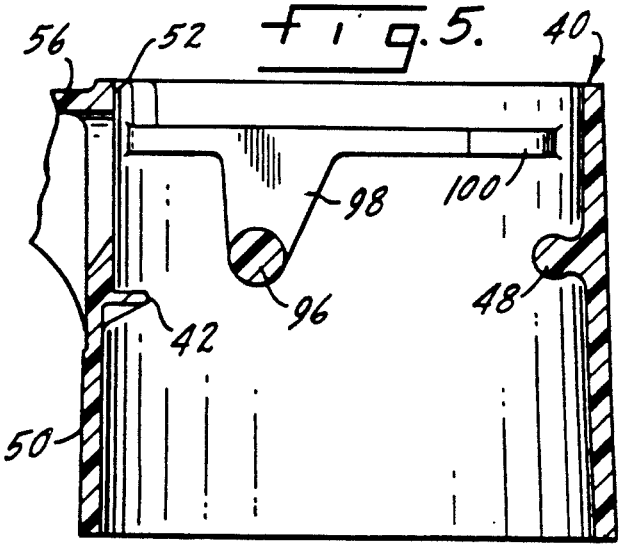
Fig. 5.

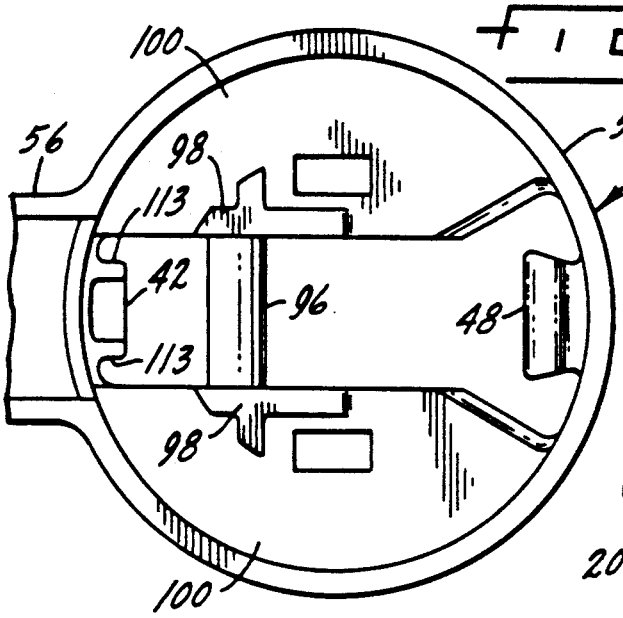
Fig. 6.
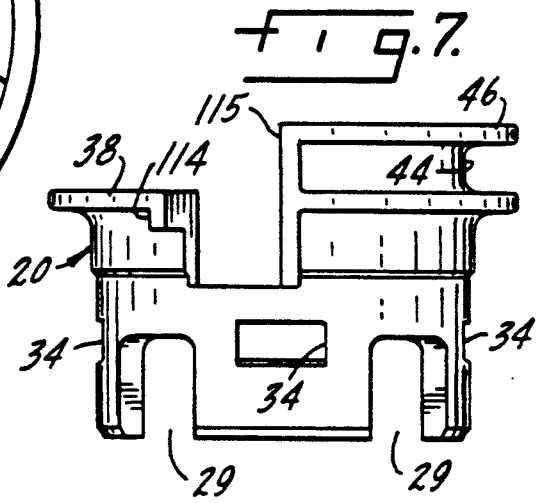
Fig. 7.
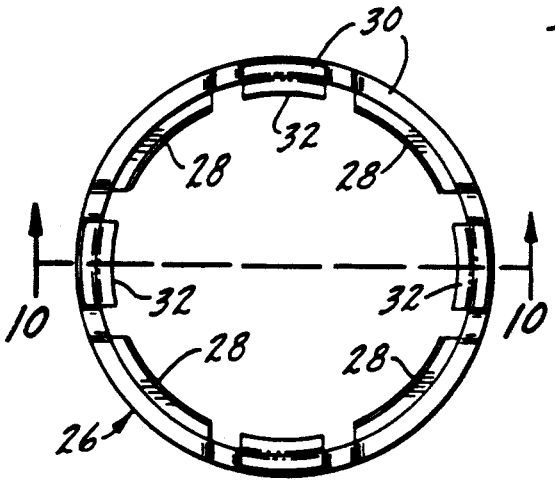
Fig. 9.
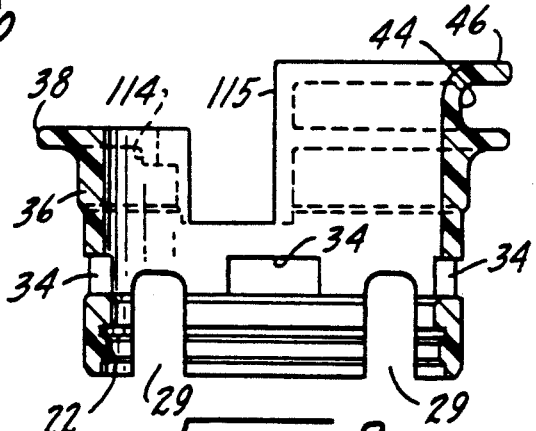
Fig. 8.
Fig. 10.
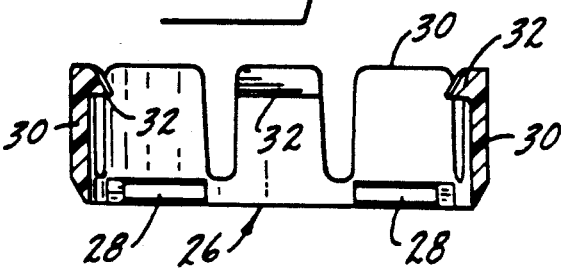

SOAP DISPENSER ASSEMBLY

THE FIELD OF THE INVENTION

The present invention relates to soap dispensers of the type conventionally found mounted on a lavatory or sink basin. The soap dispenser is normally adjacent the faucet or easily accessible to the faucet. The dispenser is operated by pressing down on a handle and normally there is a spout from which a measured amount of soap is discharged when the handle is operated. In the past, soap dispensers of this type have utilized soap passageways which are subject to corrosion, limiting the life of the dispenser and causing it to frequently clog. The present invention provides an improved soap dispenser having a plastic soap passage and one in which the soap discharge tube may be simply removed for cleaning. The dispenser may be easily removed from the top of the sink for replenishing the soap supply.

SUMMARY OF THE INVENTION

The present invention relates to soap dispensers of the type customarily found on a sink adjacent a faucet or water supply and particularly to improvements in such soap dispensers in the area of economy in manufacture and longevity.

A primary purpose of the invention is a soap dispenser for the use described which is operable by the same hand that receives soap as it is discharged from the dispenser.

Another purpose is a soap dispenser of the type described which has a plastic soap passage to eliminate corrosion and clogging.

Another purpose is a soap dispenser in which the handle has an improved mounting eliminating wobble and undesirable motion of the handle.

Another purpose is a soap dispenser utilizing components which may be easily accessed for cleaning and replacement and which is designed to provide substantial economies in manufacture.

Other purposes will appear in the ensuing specification, drawings and claims.

BRIEF DESCRIPTION OF THE DRAWINGS

The invention is illustrated diagrammatically in the following drawings wherein:

FIG. 1 is a vertical section of the soap dispenser disclosed herein;

FIG. 2 is a side view of the connector;

FIG. 3 is a bottom view of the connector;

FIG. 4 is a bottom view of the tubing adapter;

FIG. 5 is a vertical section of the handle;

FIG. 6 is a top view of the handle;

FIG. 7 is a side view of the pivot retainer;

FIG. 8 is a vertical section through the pivot retainer;

FIG. 9 is a top view of the retaining nut; and

FIG. 10 is a section along plane 10—10 of FIG. 9.

DESCRIPTION OF THE PREFERRED EMBODIMENT

The soap dispenser of the present application is designed to be mounted on a sink deck and there will be a hole in the sink deck for the soap pump. The upper portion of the pump is indicated at 10 and has a reciprocal plunger 12 extending outwardly therefrom. During operation, the handle will depress the plunger which will cause soap from within the pump to pass through the plunger into the soap discharge path to be described. Attached to the pump 10 is a mounting shank 14 which may for example be formed of brass and have a decorative coating. The mounting shank 14 has an inwardly directed projection 16 which extends beneath a shoulder 18 of the pump 10 and directly above a decorative escutcheon 15.

Mounted to the upper end of the mounting shank 14 is a pivot retainer 20, which may be formed of a suitable plastic. The pivot retainer has an inwardly directed circumferential projection 22 which snaps into a mating recess 24 in the upper end of the mounting shank. This provides the attachment of the pivot retainer to the mounting shank. In order to reduce the possibility of wobble in the attachment of the retainer to the shank, there is a retaining nut 26 which extends about the described interlock. Retainer nut 26, which may also be formed of plastic, has four inwardly directed projections 28 which bear against the exterior of the mounting shank 14 and has its body segmented into sections 30, four of which terminate at the upper end in an inwardly directed hook 32. The hooks 32 extend into openings 34 which are circumferentially spaced about the pivot retainer. Thus, the retaining nut interlocks with the pivot retainer and bears against the exterior of the mounting shank and extends about the interlock connection between the pivot retainer and mounting shank 14. Thus, the retainer nut may be moved axially toward the pivot retainer so that the hooks 32 move into openings 34.

The pivot retainer 20 has a cylindrical wall 36 which terminates at its upper end in an outwardly extending flange 38. The flange 38 is of limited arcuate extent and, as shown in the drawing, forms the upper stop for the exterior plastic handle 40. The handle 40 has an inward projection 42 which in the unoperated position shown in the drawing is in contact with the underside of shoulder 38, thus limiting the upward movement of the handle. Directly above shoulder 38 the pivot retainer has a limited arcuate recess 44, there being a second outwardly extending shoulder 46 defining the upper boundary of the recess. Shoulder 38 defines the lower boundary of the recess. Handle 40 has an inward projection 48, of limited arcuate extent, which has a rounded exterior so that the projection 48, when inserted within recess 44, provides a pivotal connection between the handle and the pivot retainer.

The handle 40 has an outer skirt 50 which, in cooperation with the exterior of the mounting shank 14, forms the decorative exterior of the soap dispenser. There is an opening 52 in the top of handle 40 and the opening is covered by a decorative cap 54. The handle 40 has a handle spout portion 56, diametrically opposite the pivotal handle mounting, which extends away from the body of the handle and has a downwardly facing opening which is closed by a throat cover 58. The throat cover 58 has a pair of inwardly directed hooks 60 which provide a snap-on connection of the throat cover to the handle. The throat cover also has a discharge portion 62 having a discharge passage 64. Directly adjacent the discharge portion 62 there is a flange 66 which interacts with a handle projection 68 to further hold the throat cover in position. The discharge portion 62 of the throat cover further includes a passage section 70 which extends from the discharge area 62 back toward the body of the soap dispenser. It should be noted that the discharge area 62 is generally directly adjacent the end of the handle portion 56 of the handle 40.

Located within the interior of the handle portion 56 is a discharge tube 72 which tightly fits about the portion 70 of the throat cover to provide a sealed soap passageway to the discharge area 62. The discharge or soap tube 72 extends into the interior of the handle and is fixed therein about a portion 74 of a tubing adapter 76. The tubing adapter 76 provides a continuation of the soap discharge path and includes an interior passage portion 78 which is generally in alignment with discharge tube 72 and a right angled passage portion 80 which extends downwardly toward the soap pump 10. The tubing adapter is plastic, as are all of the components forming the soap discharge path.

The tubing adapter is supported within a connector 82 which has a central chamber 84 into which the body 86 of the tubing connector is positioned. The connector has an inwardly directed flange 88 which cooperates with a shoulder 90 at the lower end of the tubing adapter to fix the position of the adapter within the connector.

The connector 82 has a rounded outwardly extending arm 92 having a central circular passage 94 within which is positioned a pin 96 forming a part of the handle 40. The pin 96 is mounted on a pair of arms 98 extending downwardly from the underside of the handle top 100. The described elements provide the connection between the handle 40 and the connector 82. The connector 82 mounts the tubing adapter which in turn mounts the soap tube 72 which discharges through the end of the handle portion 56 of the handle. The tubing adapter 76 extends partially within the upper end 102 of pump plunger 12. The connector 82 seats on the top 104 of the upper end of the plunger 102. The handle 40, which carries the connector 82 and thus the tubing adapter is in turn pivotally mounted on the pivot retainer by the pivot connection made up of recess 44 and element 48. The pivot retainer in turn is mounted by the described retaining nut and interlock to the mounting shank 14.

Pump plunger 12 has a lower chamber 106 and an upper chamber 108. There is a valve seat 110 between these two chambers and a stainless steel valve element 112 is positioned on the seat forming a check valve connection between the two chambers.

In normal operation, the chambers of pump plunger 12 and the soap path made up of passages 80, 78, soap tube 72, and throat cover 70, will all be filled with soap. The soap path is downwardly inclined near the discharge end and the soap is sufficiently viscous that it will not leak out of the discharge point. When the soap dispenser is operated by downward pressure, for example by the thumb of the user at the outer end of handle 56, the handle 40 will pivot on the pivot retainer. This has the effect of driving plunger 12 into the interior of soap pump 10. It also has the effect of raising ball check 112 off of its seat. As the plunger moves down, a portion of the soap within the described soap path will be forced through the soap path and out the discharge opening 64. The handle is limited in the extent to which it can be pivoted by contact between the skirt 50 and the exterior of retaining nut 26. As the handle is pivoted, which drives the plunger 12 into the soap pump, an amount of soap equal to that which is discharged is forced from chamber 106 up into chamber 108. There is a spring within the interior of the soap pump and it is the force of that spring which pushes the plunger 12 back into the position shown in the drawings, which has the effect of seating ball check 112 on its seat 110, preventing further communication between the pump, its chamber 106 and the discharge soap chamber 108. Each time the handle is operated in the manner described, an amount of soap equal to that displaced by inward movement of plunger 12 will be passed from chamber 106 to chamber 108 and that same amount of soap is what is discharged through opening 64 as the handle is moved.

Of importance is the fact that the operation point for the handle is directly above the discharge point for the soap. Thus, the user may use a thumb to press down on the handle and have the palm of the hand directly beneath the discharge opening to catch the soap. This provides a very simple and sure one-handed operation for the soap dispenser.

All of the elements making up the soap path are formed of plastic with the exception of the ball check 112 which is formed of stainless steel, a non-corrosive material. Thus, there is no possibility of the soap path corroding. The throat cover 58 is easily removable to provide access to the soap tube for cleaning purposes.

The soap dispenser handle assembly may be simply removed from the pump 10 by rotating the handle 40 diagonally to either side until side 113 of inward projection 42 meets with stop 114 of pivot retainer 20. The outer end of handle 56 is then pivoted downward slightly until the top surface of inward projection 42 clears the bottom of stop 114. Handle 40 is then rotated diagonally in the downwardly pivoted position until side 113 meets with stop 115 of pivot retainer 20. The elements of the bayonet connection are then properly aligned for removal. The retaining nut and the interlocking tubing adapter, connector, and the interior of the handle provide a secure mounting for the handle upon the mounting shank, preventing wobble of the handle during use. The operation of the soap dispenser is simple, reliable, and the motion clearly lends itself to one-handed operation.

Whereas the preferred form of the invention has been shown and described herein, it should be realized that there may be many modifications, substitutions and alterations thereto.

The embodiments of the invention in which an exclusive property or privilege is claimed are defined as follows:

1. A soap dispenser including a pump assembly having a reciprocal plunger extending outwardly therefrom, a handle assembly having an outwardly projecting handle, handle assembly mounting means attached to said pump assembly, said handle assembly being pivotally mounted on said handle assembly mounting means, a discharge tube in said handle assembly having an outlet adjacent a distal end of said outwardly projecting handle, a connector seated on said pump assembly plunger and attached to said handle assembly, said discharge tube being attached to said connector, said discharge tube, connector and plunger providing a soap passage, normally filled with soap, between said pump assembly and said outlet, a check valve in said soap passage, downward pressure on the distal end of said handle causing pivotal movement of said handle assembly about the pivotal mounting on said handle assembly mounting means causing said connector to move said plunger inwardly of said pump assembly resulting in a measured amount of soap being moved through said passage and discharged from said outlet.

2. The soap dispenser of claim 1 further characterized in that said pivotal mounting of said handle assembly is diametrically opposite said outwardly projecting handle whereby hand pressure on the distal end of said handle causes soap to be discharged from said outlet beneath the point of hand pressure application.

3. The soap dispenser of claim 2 further characterized in that said pivotal mounting includes an inwardly directed projection on the interior of said handle assembly and a cooperating recess on the exterior of said handle mounting means.

4. The soap dispenser of claim 3 further characterized in that said cooperating recess has a limited arcuate extension about the exterior of said handle mounting means providing arcuate movement of said handle assembly relative to said handle assembly mounting means.

5. The soap dispenser of claim 1 further characterized in that said check valve is located in said plunger and includes a valve seat and a valve member seated thereon.

6. The soap dispenser of claim 1 further characterized in that said handle mounting means includes a mounting shank attached to said pump assembly and a pivot retainer attached to said mounting shank, the pivotal mounting of said handle assembly being on said pivot retainer.

7. The soap dispenser of claim 6 further characterized by and including a tongue and groove connection between the upper end of said mounting shank and the lower end of said pivot retainer.

8. The soap dispenser of claim 7 further characterized by and including a retaining nut extending about and supporting the tongue and groove connection between said mounting shank and pivot retainer to prevent wobble of said handle assembly relative to said mounting shank.

9. The soap dispenser of claim 8 further characterized in that said retaining nut has an inwardly directed projection bearing against the exterior of said mounting shank and has further projections interlocking with recesses on said pivot retainer.

10. The soap dispenser of claim 1 further characterized in that said soap passage is formed of plastic.

11. The soap dispenser of claim 1 further characterized by and including a tubing adapter connected to said discharge tube, said tubing adapter forming a part of said soap passage and being mounted within said connector.

12. The soap dispenser of claim 11 further characterized in that said handle assembly includes a rod supported by a pair of arms, said connector including a recess to receive said rod whereby said connector is attached to said handle assembly.

* * * * *